US007841334B1

(12) United States Patent
DePaul

(10) Patent No.: US 7,841,334 B1
(45) Date of Patent: Nov. 30, 2010

(54) FIRE PIT COVER

(76) Inventor: Brian William DePaul, P.O. 786, Geneva, IL (US) 60134-0786

( * ) Notice: Subject to any disclaimer, the term of this patent is extended or adjusted under 35 U.S.C. 154(b) by 1069 days.

(21) Appl. No.: 11/438,234

(22) Filed: May 22, 2006

(51) Int. Cl.
*F24B 1/181* (2006.01)

(52) U.S. Cl. ..... 126/519; 126/152 R; 126/25 R

(58) Field of Classification Search ..... 126/25 R, 126/9 R, 152 R, 214 D, 519, 548; 99/450; D7/408, 409; 404/25, 26
See application file for complete search history.

(56) References Cited

U.S. PATENT DOCUMENTS 4,955,125 A * 9/1990 Steinman ..... 29/509
5,179,932 A * 1/1993 DeCarlo ..... 126/9 R
6,622,616 B1 * 9/2003 Measom ..... 99/345

* cited by examiner

*Primary Examiner*—Steven B McAllister
*Assistant Examiner*—Sarah Suereth
(74) *Attorney, Agent, or Firm*—John L. Schmitt

(57) ABSTRACT

A cover particularly adapted to extend over outdoor recreational fire pits when not in use includes a circular perforated center plate. Attached to an outer edge of this center plate is an angle-shaped rim having a downward extending vertical flange. Then, attached to a bottom side of the center plate is a centering ring. For use, a pair of spaced apart handles attached to a top side of the center plate may be used to remove the cover so that a fire may be built in the pit and then used to replaced the cover after pit use. In this latter case, the cover is positioned over the pit so that the centering ring extends into the pit next to a vertical sidewall of the pit. Any inadvertent cover movement is inhibited by an interference fit between the cover ring and the pit sidewall.

5 Claims, 1 Drawing Sheet

FIRE PIT COVER

BACKGROUND OF THE INVENTION

1. Field of the Invention

This invention relates to structure that may selectively fit over further structure containing a fire or heating element and more particularly to a cover that may selectively placed over a circular recreational outdoor fire pit when the pit is not in use.

2. Prior Art

Structures that may be selectively placed over fire holding areas are well known and have been in use for many years.

One early example of such structure is set out in U.S. Pat. No. 5,144 (Talbot) which discloses a Civil War era spider-grate attachable to a set of legs to locate the grate about an open fire. The grate comprises a flat annular ring. Attached to a bottom side of this ring is a set of spaced part inverted U-shaped channel members that provide a flat top surface for supporting food and cooking utensils being heated by a fire below.

Another example of a covering structure is disclosed in U.S. Pat. No. 2,757,622 (Buchman). In this case, the cover is part of an incinerator for out-of-doors installation. The incinerator has a shell, pyramid-like shaped body with a square top opening and a bottom side opening for removing incinerated matter. Positioned over the top opening is an upward extending perforated, frustum-like shaped cover. Alternatively, this cover may be inverted to hold combustible material such as charcoal.

Next, U.S. Pat. No. 4,077,387 (Bateman) sets out a self-extinguishing fire pit that utilities covering structure. This pit is defined in part by a cylindrically shaped, concrete sidewall sunk into the ground. In the pit is an ash pan that may rest on the ground defining a bottom of the pit or be raised to rest on a top ledge of the pit sidewall. In this latter case, a set of rods slidably attached to a bottom of the pan are slid outward to support the pan on the pit ledge. The pit may be selectively covered by a flat, circular lid having a peripheral edge that rests on the pit ledge. The lid includes an aperture for hand insertion for sliding the lid to uncover the pit, for example, or an upwardly slidable handle for the same task.

Additionally, U.S. Pat. No. Des. 383,029 (Strelcheck Jr. et al) discloses a multipurpose outdoor fire pit having a circular body member formed with an inner, circular, bowl-shaped fire material holding plate. Extending upward from a top ledge of the body member are four spaced apart uprights that support a dome-shaped cover that shields the fire material holding plate from the elements. When not is use this cover may be placed directly on the pit body top ledge using two spaced apart handles attached to the cover outer side. When a fire is burning on the holding plate, the cover may be used as a deflector. In this case, the cover is held upright by two of the uprights having upper ends inserted into spaced apart handles attached to an inner side of the cover.

Other cover structure of general interest are disclosed in U.S. Pat. No. Des. 323,500 (Griffard); U.S. Pat. No. Des. 485,469 (Siegal et al.); U.S. Pat. No. Des. 428,305 (Berkes); U.S. Pat. No. 3,515,118 (Beller); and U.S. Pat. No. 3,937,138 (Tidwell).

SUMMARY OF THE INVENTION

A cover of this invention is particularly adapted for use with circular outdoor fire pits that are now popular congregating places during social events. The cover includes a circular body defined in part by a perforated center plate. Connecting with a peripheral edge of the center plate is an angle-shaped rim having a downward extending vertical flange. Attached to a bottom side of the center plate is a centering ring sized to fit next to an inside of a circular sidewall of the fire pit. Attached to a top side of the cover center plate is a pair of spaced handles.

When the pit is not in use, the handles may be used to position the cover over the fire pit so that the centering ring extends into the pit and a bottom edge of the rim flange seats on a horizontal ledge of the pit. When the fire pit is to be used, the handles allow for ready removal of the cover for storage at a remote location.

The cover of this invention provides several advantages of over fire pit covers known or now in use.

First, as the cover is installed over a fire pit, the centering ring prevents cover movement since such movement in any direction quickly produces an interference fit between the ring and the fire pit sidewall. Additionally, the centering ring reinforces the center plate allowing use of a thinner center plate material. Therefore, the ring insures that the pit remains fully covered during darkness or during winter months, for example, when the pit area could be covered with snow. A partially cover pit is a serious hazard under any conditions. Additionally, the centering ring insures the structural integrity of the cover. At the same time, the cover has a reduced weight to promote cover handling and reduced cost.

Another advantage is that, as the cover is installed on a fire pit, the only contact between the pit and the cover is between the bottom edge of the rim and the fire pit ledge. Since this ledge typically is made of stone or like ceramic material, minimizing the area of contact inhibits discoloration of the ledge material if moisture, leaves or like material were to become compressively entrapped between the cover and the ledge.

A still further advantage is that the perforations of said center plate allow a fire in the fire pit to continue to burn when the cover in place. For a next use the fire pit is substantially free of unburnt matter.

DESCRIPTION OF THE DRAWING FIGURES

DESCRIPTION OF THE PREFERRED EMBODIMENT

Figure 1:
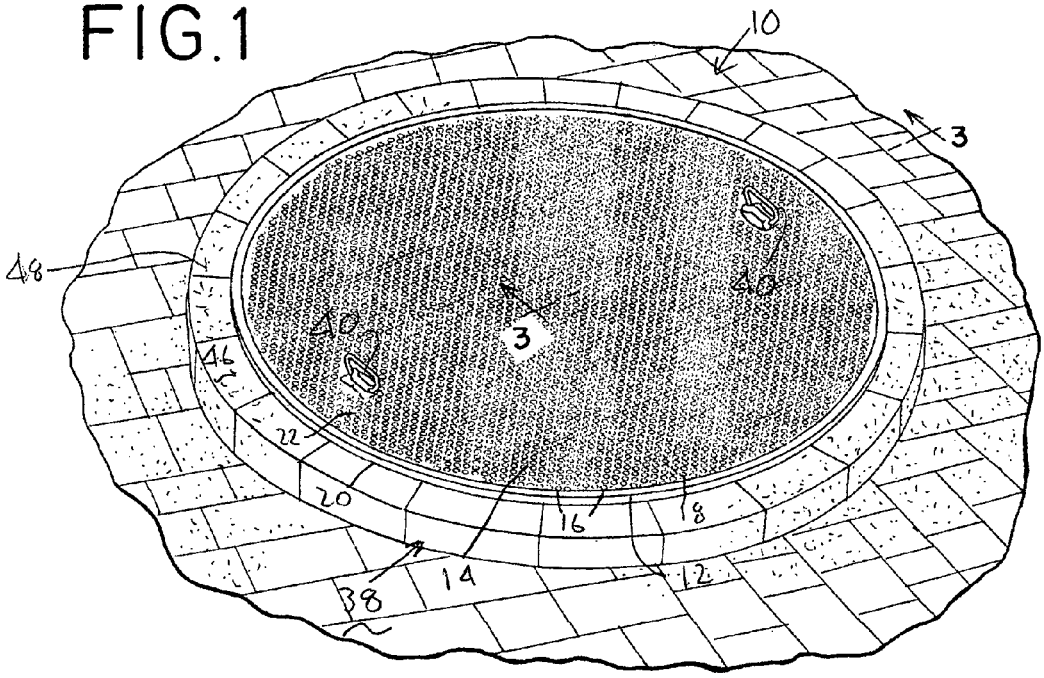
FIG. 1 is perspective view of a cover of this inventions as installed over a typical fire pit.
Figure 2:
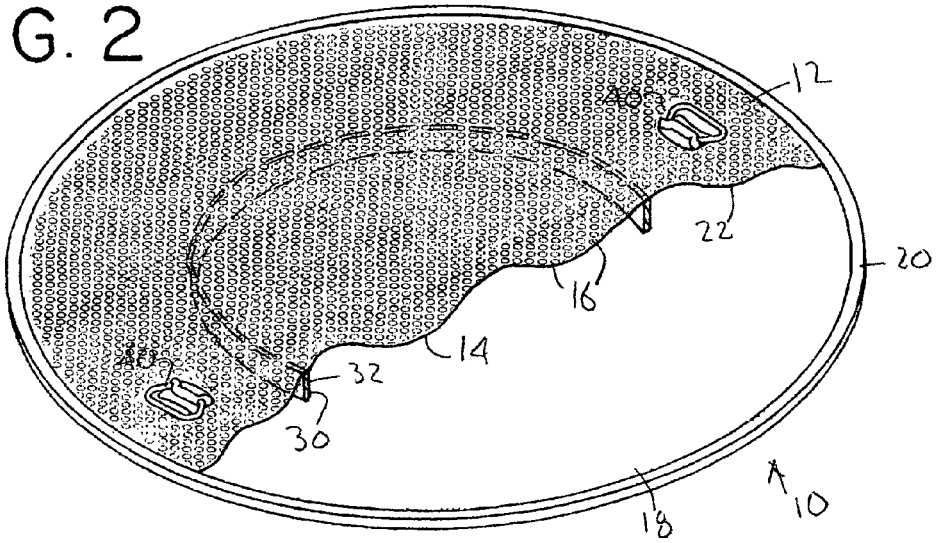
FIG. 2 is a perspective view of a portion of the fire pit cover seen in FIG. 1.
Figure 3:
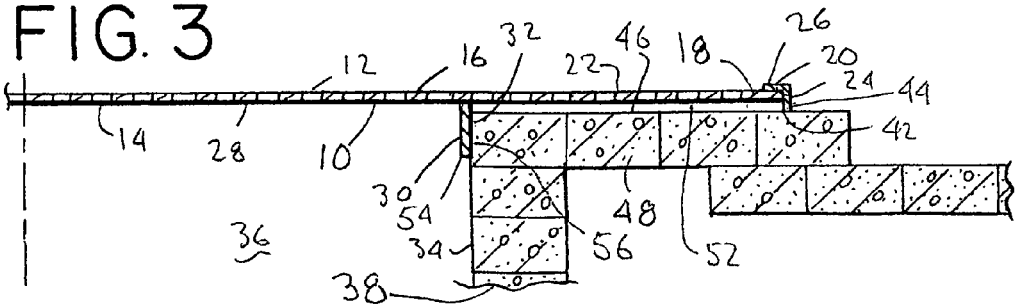
FIG. 3 is a cross sectional view as seen generally along the line 3-3 in FIG. 1.

A fire pit cover of the invention is shown generally in FIGS. 1 and 2 and designated 10. The cover 10 has a circular body 12 comprising a perforated center plate 14. The perforations 16 are spaced and sized so that about 60 percent of the plate 14 is open. As seen in FIG. 3, a peripheral edge 18 of the center plate 14 connects with an angle-shaped rim 20 with a top side 22 of the plate 14 fitting against a bottom surface 24 of a horizontal flange 26 of the rim 20. Attached to a bottom side 28 of the center plate 14 is a centering ring 30. A diameter of an outer side 32 of the ring 30 is sized to fit loosely next to a sidewall 34 of a combustion chamber 36 of a fire pit 38, see FIG. 3. Attached to the top side 22 of the center plate 14 is a pair of spaced apart handle 40. The components of the cover body 12 are preferable made of stainless steel or other like corrosion resistant material.

When the fire pit 38 is not in use, the cover 10 is placed over the pit 38, see FIG. 1. As positioned, a bottom edge 42 of a vertical flange 44 of the rim 20 seats on a top surface 46 of a horizontal ledge 48 of the fire pit 38 to form about an one-half inch high air space 52 between the ledge 48 and a bottom side 28 of the cover center plate 14. This air space 52 allows any moisture in the space 52 to evaporate through the cover perforations 16. Except for the area of contact by the rim vertical flange bottom edge 42, all other exposed surfaces of the fire pit 38 are free to breathe. This is important since any moisture accumulation, particularly if combined with vegetation such a leaves, can result in ledge discoloration or moisture caused erosion to the masonry of the fire pit ledge 48. As the cover 10 rests on the fire pit ledge 48, the cover centering ring 30 extends into the fire pit chamber 36. The centering ring outer side 32 fits loosely next to the pit chamber sidewall 34, and a bottom edge 54 of the ring 30 locates about one and one-half inches below the pit horizontal ledge top surface 46. Any inadvertent movement of the cover 10 is inhibited by an immediately forming interference fit 56 between the cover centering rim 30 and the fire pit chamber sidewall 34. At the same time, the centering ring 30 reinforces the center plate 14 allowing a person to walk safely over the cover 10 as positioned over the fire pit 38. It should be understood that other structure can provide the centering ring's positioning and reinforcing functions. For example, two bars in a crossing configuration or a set of bars in a spoke array could produce a similar result.

When a fire is to be built in the fire pit 38, the cover handles 40 allow ready removal of the cover 10 for storage in a remote location. Handling of the cover 10 is facilitated by its lighter weight made possible by a lighter weight but structurally sound center plate 14.

While an embodiment, uses, and advantages of this invention have been shown and discussed, it should be understood that this invention is limited only by the scope of the claims. Those skilled in the art will appreciate that various modifications and changes may be made without departing from the scope and spirit of the invention, and these modifications and changes may result in further uses and advantages.

I claim:

1. A fire pit cover comprising:

a center plate having openings that allow air to flow into a fire pit with said cover in place over said pit, a downward extending rim immovably attached to a peripheral edge of said center plate, said rim having a downward extending bottom edge prepared to seat on a ledge of said fire pit and position said center plate above said ledge, centering means immovably attached to said center plate inward from said rim and extending below a bottom side of said center plate, said means having an outer side prepared to fit loosely next to a wall of said fire pit and form an interference fit with said pit wall to inhibit inadvertent lateral movement of said cover when said cover is in place over said pit, and handle means carried by said cover to facilitate movement of said cover, wherein using said handle means, said cover may be readily removed from said fire pit or positioned over said fire pit.

2. A cover as defined by claim 1 and further characterized by, said centering means comprising a ring having a bottom edge that extends below a bottom edge of said rim, wherein said ring inhibits lateral movement of an installed fire pit cover.

3. A cover as defined by claim 1 and further characterized by, said center plate openings having a combined area equaling proximately equal 60 percent of an area of said center plate, wherein said openings allow said plate to have a reduced weight while said centering means enhances the structural integrity of said center plate.

4. A cover as defined by claim 1 and further characterized by, said rim having an angle-like shape including a horizontal flange having a bottom surface affixed to a top side of said center plate and a vertical flange providing said rim bottom edge prepared to engage said fire pit ledge, wherein as said rim flange bottom edge engages said fire pit ledge, said center plate is positioned sufficiently above said ledge to inhibit entrapped debris ledge discoloration, and said centering means enhances cover placement, remains inside and next to said fire pit wall to inhibit cover lateral movement, adds structural strength to said center plate, and facilitates reduced center plate weight.

5. A fire pit cover particularly adapted to extend over a fire pit when said pit is not in use, said cover comprising:

a circular center plate made of a light weight perforated-like material, an angle-shaped rim connecting with a peripheral edge of said center plate, said rim defined by a horizontal flange having a bottom surface joined to a top side of said center plate and a vertical flange having a bottom edge prepared to engage a top surface of a ledge of said fire pit to hold said center plate above said ledge, a centering and reinforcing ring immovably attached to a bottom side of said center plate and inwardly offset from said rim, said ring having an outer side prepared to fit loosely next to a sidewall of a chamber of said fire pit and a bottom edge to extend below said ledge top surface as said rim vertical flange bottom edge engages said pit ledge, and a pair of spaced apart handles attached to said cover proximate said cover rim, wherein, with said cover in place over said fire pit, said centering ring forms a non directional interference fit with said pit sidewall to inhibit an inadvertent lateral uncovering movement of said cover as said rim vertical flange bottom edge minimally engages said pit ledge.

* * * * *